US007159674B2

(12) United States Patent
Egerstrom

(10) Patent No.: US 7,159,674 B2
(45) Date of Patent: Jan. 9, 2007

(54) METHOD AND DEVICE FOR DIRECTIONAL DOWN-HOLE DRILLING

(75) Inventor: Fredrik Egerstrom, Nacka (SE)

(73) Assignee: Wassara AB, Stockholm (SE)

( * ) Notice: Subject to any disclaimer, the term of this patent is extended or adjusted under 35 U.S.C. 154(b) by 0 days.

(21) Appl. No.: 10/507,825

(22) PCT Filed: Feb. 24, 2003

(86) PCT No.: PCT/SE03/00292

§ 371 (c)(1),
(2), (4) Date: Nov. 5, 2004

(87) PCT Pub. No.: WO03/076759

PCT Pub. Date: Sep. 18, 2003

(65) Prior Publication Data

US 2005/0252687 A1 Nov. 17, 2005

(30) Foreign Application Priority Data

Mar. 14, 2002 (SE) ..... 0200780

(51) Int. Cl.
*E21B 7/04* (2006.01)
*E21B 4/14* (2006.01)

(52) U.S. Cl. ..... 175/61; 175/296

(58) Field of Classification Search ..... 175/61, 175/293, 296
See application file for complete search history.

(56) References Cited

U.S. PATENT DOCUMENTS 2,756,966 A * 7/1956 Bassinger ..... 173/73
3,978,931 A 9/1976 Sudnishnikov et al.
4,852,669 A * 8/1989 Walker ..... 175/73
5,339,913 A 8/1994 Rives
5,441,119 A 8/1995 Head
5,735,357 A 4/1998 Palm
6,659,202 B1 * 12/2003 Runquist et al. ..... 175/61

FOREIGN PATENT DOCUMENTS

DE 299913 A 8/1917
WO WO 03/064805 A1 8/2003

* cited by examiner

*Primary Examiner*—David Bagnell
*Assistant Examiner*—Giovanna M Collins
(74) *Attorney, Agent, or Firm*—Nixon & Vanderhye P.C.

(57) ABSTRACT

The invention concerns a method and a device for directional drilling of a hole, in particular when drilling curved holes for mining, drift mining or similar, whereby a drill support is used in the form of a flexible continuous drill tube with a proximal end and a distal end, that at the end of the drill support distal end is connected a down hole assembly comprising a drill bit for forming a drill string, which is fed into the gradually forming hole. To avoid and minimize the occurrence of "stick slip" during directional drilling, according to the method, the drill support while drilling is taking place is held fixed at its proximal end against rotation outside the borehole and the rotating motion for indexing the drill bit around an axis extending in the direction of drilling is performed in the area between the drill support's distal end and the drill bit while drilling is in progress.

4 Claims, 1 Drawing Sheet

METHOD AND DEVICE FOR DIRECTIONAL DOWN-HOLE DRILLING

This application is a U.S. national phase of international application PCT/SE03/00292 filed in Swedish on 24 Feb. 2003, which designated the U.S. PCT/SE03/00292 claims priority to SE Application No. 0200780-5 filed 14 Mar. 2002. The entire contents of these applications are incorporated herein by reference.

BACKGROUND OF THE INVENTION

The present invention concerns a method for directional down-hole drilling. The invention also concerns a device for carrying out the method.

For directional drilling in rock, drift mining or blast hole and well drilling a drill support in the form of coil tubing is used, which means that instead of a series of conventional rigid drill tubes a flexible continuous drill tube with one proximal and one distal end is used. The flexible drill support is unreeled from a spool and fed successively into the borehole. To form a drill string, a continuous bottom hole assembly (BHA), which includes a drill machine, is fastened at the distal end of the drill support. A percussion unit in the form of a fluid-pressure activated hammer or similar reciprocal mass is arranged on the drill machine to apply a drill bit fastened to the drill machine axially against the opposing rock surface. The bottom hole assembly (BHA) usually also comprises some kind of positioning device, so-called measurement while drilling (MWD). A driving fluid intended for the motors included in the BHA is led via a passage extended through the drill support. The rock cuttings are transported away from the worked area and out of the borehole with the used driving fluid.

In order switch the contact points of the drill bit studs and to make them work on uncut rock, the drill machine must be indexed or gradually rotated around its axis between each blow of the drill bit. This is normally achieved by rotating or twisting the flexible drill support with some kind of rotating arrangement situated outside the borehole.

For directional control of the drill bit inside the borehole, there is a steerable motor arranged in the BHA that conveys motion through a universal joint or other suitably flexible part so that the drill bit can take on different angles relative to the drill support. The said BHA normally constitutes a fluid activated motor in the form of a so-called mudmotor that, like the other motors in the BHA, is supplied with a driving fluid via a passage extending through the drill support.

When drilling deep holes, so-called "stick slip" can arise due to the rotation of the drill support, which at its proximal end is continuous or uniform, becoming irregular at its distal end so that the drill support acts like a torsion spring instead of indexing the drill machine evenly between blows from the percussion unit. This means that the drill machine will be standing still for several blows and accumulating torque before running away uncontrollably while performing a very rapid rotation. This "stick-slip" effect reduces the penetration rate and increases bit wear.

One considerable difference between conventional linear drilling with drill support comprising a series of joinable drill tubes and a flexible drill tube of coil string type is that the use of a flexible drill support allows only a relatively small application force on the drill bit, considerably reducing the efficiency of the drilling technique. In particular with regard to directional drilling of curved holes, this limitation is tangible because a large part of the application force is lost in each part of the drill tube that bends. This problem is due partly to geometric conditions but also partly to the large static forces of friction that arise at each deflected part of the drill support. In this part, it should be understood that the aforesaid problems become greater as the curve radius becomes smaller.

Recently, it has become increasingly common to use directional drilling, which puts higher demands on equipment efficiency and especially when drilling series of non-linear holes, i.e. curved or crooked holes. One example of this is in cases where it is necessary to avoid drilling in non-ore bearing rock but to efficiently control the drilling direction directly towards the ore-bearing bodies in the rock.

SUMMARY

One objective of the present invention is to minimise the occurrence of "stick slip" during directional drilling, in particular when drilling curved holes with small radii because the forces of friction that hereby arise between the flexible drill support and the rock or wall of the hole become very large when rotating the drill support for indexing of the drill machine.

These objects of the invention can be achieved with the device according to the present invention having been given one or more of the distinctive features and characteristics specified below.

BRIEF DESCRIPTION OF THE DRAWINGS

The following is a more detailed description of this invention with references to FIG. 1, which is a schematic view of an embodiment of the present invention.

DETAILED DESCRIPTION OF ILLUSTRATED EMBODIMENTS

Figure 1:
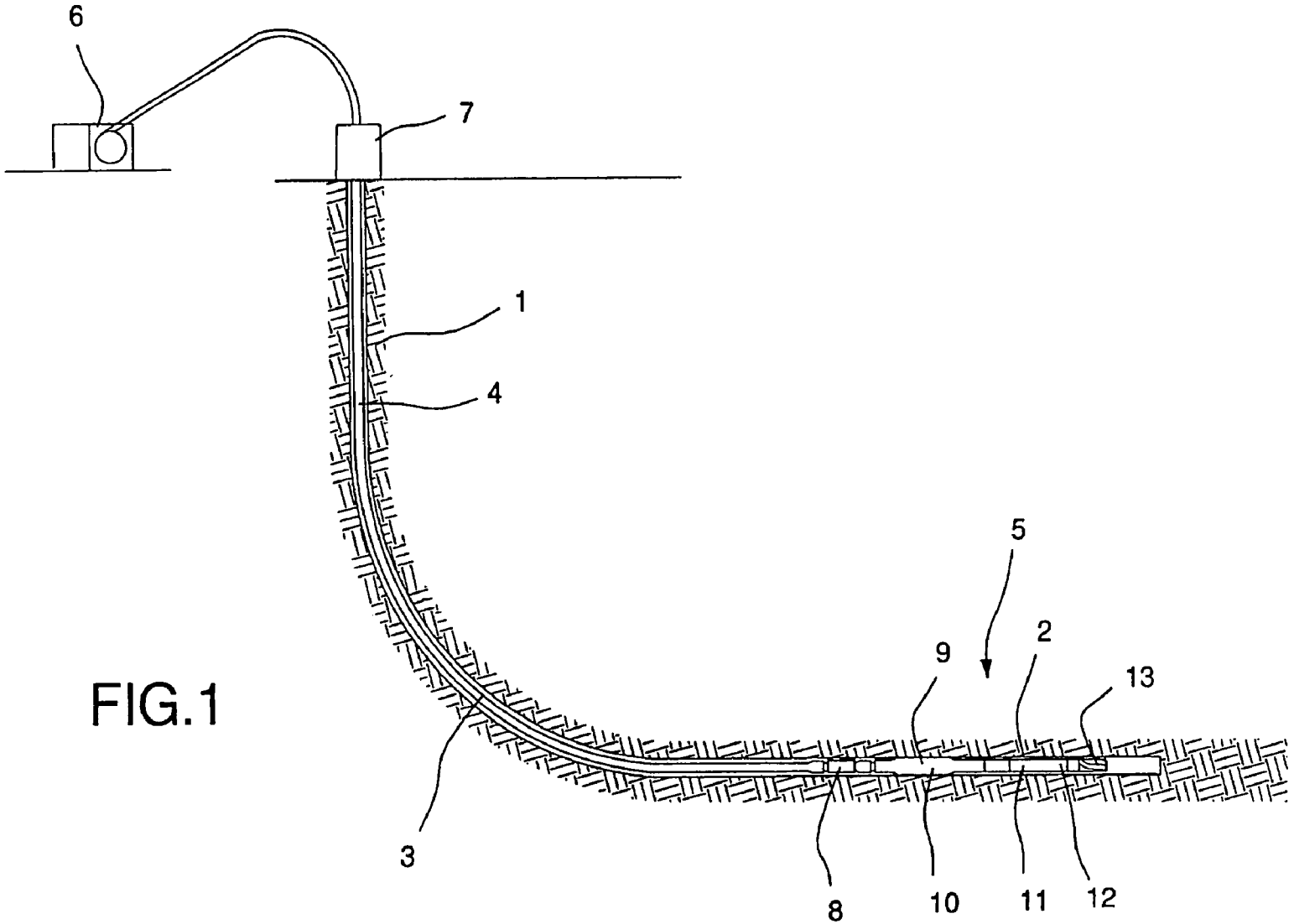

Referring to FIG. 1 is shown an example of the equipment that according to the invention is used for directional drilling in the transition from a vertical section 1 to a horizontal section 2 of a borehole 3 in rock. At the distal end of a tubular flexible drill support 4 of so-called "coil string" type is arranged a bottom hole assembly (BHA) generally designated 5. 6 designates a drum on which the flexible drill support 4 is wound and 7 a means of feeding the drill support down into the gradually formed borehole.

In order to form something that below is called a drill string, the bottom hole assembly 5 comprises, viewed from the distal end of the drill support, a percussion tool 8, a positioning device 9 or a so-called "measurement while drilling" (MWD), a control device 10 in the form of a motor for inclining or setting the position of the assembly, an indexing device 11 and a drill machine 12 with drill bit 13. The indexing device 11 is intended to gradually rotate the drill machine around the main axis of the drill bit extending in the drilling direction and is primarily of a suitable conventional design like other units included in the assembly such as the percussion tool, MWD equipment and the drill machine.

From a purely design point of view, the indexing device 11 can be designed in a number of different ways and in the embodiment described herein comprises a rotatable fluid motor of mud type and a motor-driven valve arrangement used to turn the whole drill machine through a certain angle (index) between each blow. In operation, a drive fluid comprising a mixture of water or a suspension of bentonite clay in water flows through the motor, which in turn drives the valve arrangement. In a known manner, the valve arrangement is so designed and balanced that a variation of the drive fluid passing through the motor will result in a change of the flow balance through the valve arrangement, which in turn is so connected to a motor or similar actuator included in the indexing device that the drill machine 12 is turned through a certain angle under the influence of the motor.

In a similar manner, the other units included in the bottom hole assembly is equipped with motors and valve arrangements designed to control and regulate through varying the flow of drive fluid passing through the motor.

In operation, the percussion tool 8 generates an axial reciprocating movement that is conveyed to the drill machine so that the drill bit 13 arranged in the same attains a drilling action against the opposing rock surface. The drill bit 13 is gradually fed into the hole via a feed device 7 while it is applied with a certain force against the opposing rock surface. The feed device 7 holds the proximal end of the drill support torsionally fast against any torsional forces occurring in the borehole 3. Normally, the drill bit 13 is driven forward in this way in a linear direction inside the borehole. In a conventional manner, a directional control of the drill bit 13 is performed through the action of the control device 10 with motor and the adjustable joint connected to it, whereby the direction can be checked with the measurement while drilling (MWD) equipment.

To make the axially reciprocating drill bit 13 studs continually act on unworked rock, the drill bit must be indexed or rotated in suitable steps around the drill axis in conjunction with each blow. Using known technology, this can be achieved with a means of rotation situated outside the hole.

According to principles of the present invention however, indexing is achieved in close conjunction with the drill machine by means of an indexing device 11 that is driven by fluid passing through a motor included in the indexing device.

The indexing device 11 is synchronised with the percussion tool in such a way that the indexing and rotation of the drill machine 12 takes place in conjunction with the drill bit 13 moving away from the rock surface. As indexing takes place in close conjunction with the drill bit 13 and not through external rotation of the continuous drill support 4, problems such as "stick slip" can be avoided to a high degree.

Swedish patent application no. SE 0104217-5, and U.S. Published Application No. U.S. 2005/0011680 A1, which claims priority to Swedish Patent Application No. 0104217-5, show and describe a new type of fluid-driven down-hole rock drill which hereby is incorporated as a reference in the present application. On this down-hole rock drill, the drill bit is mounted rotationally fixed but axially limited in a bit sleeve, which in turn is supported in a rotatable mounting in a housing included in the down-hole rock drill. A ram included in the drill machine is arranged to impact on the neck of the drill bit, a valve is arranged to control the reciprocating motion of the ram, wherein the valve alternately applies pressure and relieves pressure in a chamber with a piston surface that when under pressure drives the ram forward. One interesting feature of this drill machine, unlike conventional BHAs in which the respective units are arranged in line after each other in the direction of drilling, is that some of the drive fluid used to activate the percussion ram is diverted to drive a means of rotation arranged on the bit sleeve for indexing the bit sleeve and thereby the drill bit. This rotation means is so synchronized with the ram that indexing is performed when the drill bit is in its rearmost end position or more precisely when it moves back away from the rock surface.

This design contributes to the relatively short length of the BHA, which offers the advantage of the force that is applied via the flexible drill support being much closer to the working area of the drill bit. It should be understood that the controlling the drill bit with small curve radii is hereby facilitated and that only very little power is lost on the way to the drill bit, even when the drill support diverts at a very small curve radius.

The present invention is not limited to the above description or as illustrated in the drawings but can be changed and modified in a number of different ways within the framework of the idea of invention specified in the following claims.

The invention claimed is:

1. Method of directional drilling of a hole, for which is used a drill support in the form of a flexible continuous drill tube with proximal end and distal end, that at the end of the drill support's distal end is connected a bottom hole assembly comprising a drill machine and a percussion tool acting on a drill bit for forming a drill string, which is fed into the gradually formed hole, the method including:

indexing the drill bit while drilling is in progress by gradually rotating around its axis between each blow of the drill bit, performing the indexing in the area between the drill support's distal end and the drill bit, the indexing taking place when the drill bit is moving away from a rock surface or being in its retracted position, carrying out the indexing using a rotatable fluid activated motor, a liquid driving fluid for which is fed via a passage that extends through the drill support; and controlling the direction of the drill bit relative to the drill support using a controller including a motor adjustable joint, said bottom hole assembly including said controller.

2. Method according to claim 1, whereby the drill bit rotates around the drill axis in defined steps by the fluid activated motor.

3. Method according to claim 1, whereby the bottom hole assembly is of the type that allows some of the drive flow used to activate the drill bit action to be alternately diverted for rotating and indexing the drill bit.

4. Device for directional drilling of a hole, comprising a drill support in the form of a flexible continuous drill tube with a proximal end and a distal end and a bottom hole assembly comprising a drill machine and a percussion tool acting on a drill bit also allowing the drill bit to be rotated while drilling is in process the assembly being connected at the end of the drill support's distal part for forming a drill sting, and a means of feeding the drill string into the gradually forming borehole, wherein the bottom hole assembly comprises a fluid activated means for indexing and rotating the drill bit around an axis extending in the direction of drilling while drilling is in progress, the indexing means being so synchronized to the percussion tool that the indexing taking place when the drill bit is moving away from a rock surface or being in its retracted position, a passage extended through the drill support for supporting the indexing means with a liquid driving fluid, and wherein the bottom hole assembly comprises a controller including a motor adjustable joint to control the direction of the drill bit relative to the drill support.

* * * * *